US005644921A

United States Patent [19]

Chowdhury

[11] Patent Number: 5,644,921

[45] Date of Patent: Jul. 8, 1997

[54] ULTRA HIGH PURITY DELIVERY SYSTEM FOR LIQUEFIED COMPRESSED GASES

[75] Inventor: Naser Mahmud Chowdhury, Orefield, Pa.

[73] Assignee: Air Products and Chemicals, Inc., Allentown, Pa.

[21] Appl. No.: 651,311

[22] Filed: May 22, 1996

[51] Int. Cl.[6] ..... F17C 9/02

[52] U.S. Cl. ..... 62/48.1; 62/50.2

[58] Field of Search ..... 62/48.1, 50.2

[56] References Cited

U.S. PATENT DOCUMENTS

| | | | |
|---|---|---|---|
| 2,842,942 | 7/1958 | Johnston et al. . | |
| 3,827,246 | 8/1974 | Moen et al. | 62/48.1 X |
| 4,386,650 | 6/1983 | Moen | 62/48.1 X |
| 4,579,566 | 4/1986 | Brugerolle | 55/50 |
| 4,693,252 | 9/1987 | Thoma et al. | 62/48.1 X |
| 4,961,325 | 10/1990 | Halvorson et al. | 62/48.1 |
| 5,242,468 | 9/1993 | Clark et al. | 29/25.01 |
| 5,373,701 | 12/1994 | Siefering et al. | 62/48.1 |

FOREIGN PATENT DOCUMENTS

| | | | |
|---|---|---|---|
| 2753495 | 6/1979 | Germany | 62/48.1 |
| 0010148 | 1/1980 | Japan | 62/48.1 |
| 1008566 | 3/1983 | U.S.S.R. | 62/48.1 |

*Primary Examiner*—Christopher Kilner
*Attorney, Agent, or Firm*—Geoffrey L. Chase

[57] ABSTRACT

A method and apparatus for storing ultra high purity non-cryogenic liquefied compressed gases, such as ammonia ($NH_3$), and delivering a vaporized gaseous product from those liquefied gases for semiconductor processing applications. The delivery method includes withdrawing and heating gaseous product from a storage vessel containing the liquefied compressed gas, and then piping the heated gas through the liquid contained in the storage vessel in a heat exchange fashion. The heat exchange with the liquid inside the vessel induces boiling to maintain a vaporized gaseous product under a minimum positive pressure in said vessel. After liberating its heat, the gaseous product is delivered to a semiconductor manufacturing point of use.

14 Claims, 2 Drawing Sheets

ULTRA HIGH PURITY DELIVERY SYSTEM FOR LIQUEFIED COMPRESSED GASES

TECHNICAL FIELD OF THE INVENTION

The present invention relates to a method and apparatus for the storage and delivery of ultra pure gases for, inter alia, semiconductor processing. In particular, the present invention provides a system that maintains an elevated pressure in a bulk storage vessel without compromising the product's ultra high purity.

BACKGROUND OF THE INVENTION

In order to avoid defects in the fabrication of semiconductor devices, semiconductor manufacturers require high purity gases and chemicals for their production processes. Typical processing steps include using cleaning solvents for initial wafer preparation, wet etching, chemical vapor deposition, and the like. The presence of very minute amounts of impurities at any one step may result in contamination of the wafer and ultimately in the scrapping of the chip.

Two sources of impurities that result in wafer contamination include particulates and films. Particulates include any bits of material present on a wafer surface that have readily definable boundaries. As state of the art mask designs commonly have line widths in the sub-micron range, particulates may very easily interfere with the proper operation of the chip circuits. This is especially true in the case of charged particles, which may interfere with the electrical characteristics of the chip. Film contamination results when a layer of a foreign material remains on a chip after a processing step. Solvent residues and oils are common films that undesireably remain on a chip, cause contamination and ultimately reduce wafer yields. Additionally, the presence of heavy metals such as Fe, Ni, Cr, Cu, Al, Mn, Mo, Zn, and the like may contaminate a wafer as either a metallic film or as metallic particulates. As a means to increase yields, semiconductor fabrication houses (fabs) commonly require that their process gases meet particle specifications of less than 0.2 micron, and metals specifications on the order of 1 part per billion or less. By understanding the extremely sensitive nature of chip fabrication, one may appreciate why labs maintain such stringent purity standards for their wafer processing gases and chemicals. One may further anticipate that such standards will become more stringent in the future, as the geometry of semiconductor devices continues to get smaller.

Traditionally, semiconductor manufacturing facilities or fabs as they are referred to in the industry have used electronic grades of process gases which producers have supplied in cylinders. The cylinders contain gas volumes on the order of 40 litters and are installed in gas cabinets, which contain one or two process gas cylinders per station. The gas cabinets are maintained in a controlled temperature environment such that the vapor pressure of liquefied compressed gases may be controlled. In order to meet the ever increasing demands for semiconductor chips, labs have installed more gas cabinets. The increased number of gas cabinets has consequently challenged the user in regard to operational safety, as cylinder changes become more frequent and there is increased likelihood of component failure. Of course the increased operational and maintenance requirements also increase the likelihood that impurities may be introduced into process gas streams. Furthermore, such an approach to maintaining production is undesirable from an economic standpoint, as the need for identical delivery systems and components increases capital equipment, installation, and operational costs.

As an alternative to the above described method of delivering process gases, users of large volumes of liquefied compressed process gases have met flow demands by pumping liquid product from a storage vessel and vaporizing it prior to use. The advantage of this technique being that the pump enables a user to pressurize the delivery system according to process needs. While this method is straight forward for large volume, low purity users, the process becomes more complicated for large volume high purity users, such as the semiconductor industry. Experimental results have shown that chemical withdrawn from the liquid phase of a storage vessel contains substantially higher levels of metallic and oil contaminants than chemical that is withdrawn from the vapor phase of a storage vessel. When the withdrawn liquid is vaporized, the flow stream carries the impurities into the vapor stream to the point of use. Consequently, high purity users such as labs would have to rely on purifiers to remove the contaminants.

U.S. Pat. No. 5,242,468 discusses the problems in the semi-conductor industry and puts forth a proposed on-site solution for purifying chemicals for use in a semi-conductor fabrication house.

U.S. Pat. Nos. 4,579,566; 4,961,325 and 2,842,942 disclose methods and devices for maintaining pressurization of a cryogenic storage vessel. The 566' and '325 patents utilize vaporization of stored liquid to pressurize the vapor space in a cryogenic storage vessel. The '942 patent vaporizes cryogenic liquid using heat exchangers that provide ambient heat to vaporize the cryogen and heat exchange it with the liquid supply of the cryogen to maintain pressure. It is known to supply gaseous hydrogen from a liquid cryogen hydrogen supply by this method.

From the above discussion, it becomes clear that the semiconductor industry requires an improved technique to deliver ultra pure gases to their manufacturing processes using an operationally safe, cost effective bulk source and delivery system. Such a system must be able to maintain a minimum delivery pressure defined by the user.

SUMMARY OF THE INVENTION

In order to satisfy the need for a safe and cost effective bulk source and delivery system the present invention provides a method and apparatus for delivering ultra high purity process gas from a storage vessel containing a large quantity of non-cryogenic liquid chemical product where the chemical has at least a vapor phase and a liquid phase. Vaporized product is withdrawn from the top of the storage vessel, the vapor having a lower concentration of impurities than the compressed liquid phase. Vapor withdrawn from the tank is heated with a source of heat providing heat in excess of available ambient heat and passed in heat exchange relationship with the pool of non-cryogenic liquid to promote further vaporization of product inside of the tank. The withdrawn vapor is circulated through the pool of product for a period of time and for a number of cycles required to maintain a minimum pressurized condition inside of the vessel. During periods that the user has no need for product, the vaporized product can be withdrawn and vented through an abatement system to maintain the storage vessel under suitable pressure. Process engineering for specific installations will be influenced by the properties of the fluid being delivered, the ambient temperature, the storage vessel's heat transfer characteristics, use requirements for withdrawn product, and the pressure level desired inside of the storage vessel.

DETAILED DESCRIPTION OF THE INVENTION

The present invention permits delivery of ultra high purity (UHP) process gas in bulk quantities for use by semiconductor manufacturing facilities. The requirement for large quantities of ultra pure chemicals by semi-conductor manufacturing facilities results from processing wafers of larger diameters coupled with more stringent purity requirements. Process gases that may be delivered by the invention include $NH_3$, HF, $SiHCl_3$, $SiH_2Cl_2$, $C_4F_8$, $C_3F_8$, and the like. Ultra high purity gases for the electronics industry typically have less than 1 part per billion (ppb) by volume of contaminants to which the end uses are sensitive, such as metals like aluminum, boron, iron, nickel, silver and the like.

The present invention is directed to non-cryogenic liquid products which can be vaproized to gaseous products using an external heater providing heat in excess of the heat available from the ambient environment. Cryogenic liquids, those liquefying at or below −90° F., may be vaporized by merely adding heat from the ambient to reach acceptable delivery pressures. Acceptable delivery pressures vary for each product and the end user demands, but for ammonia a delivery pressure of at least 50 psig, preferably 75 psig, most preferably 100 psig is required.

Figure 1:
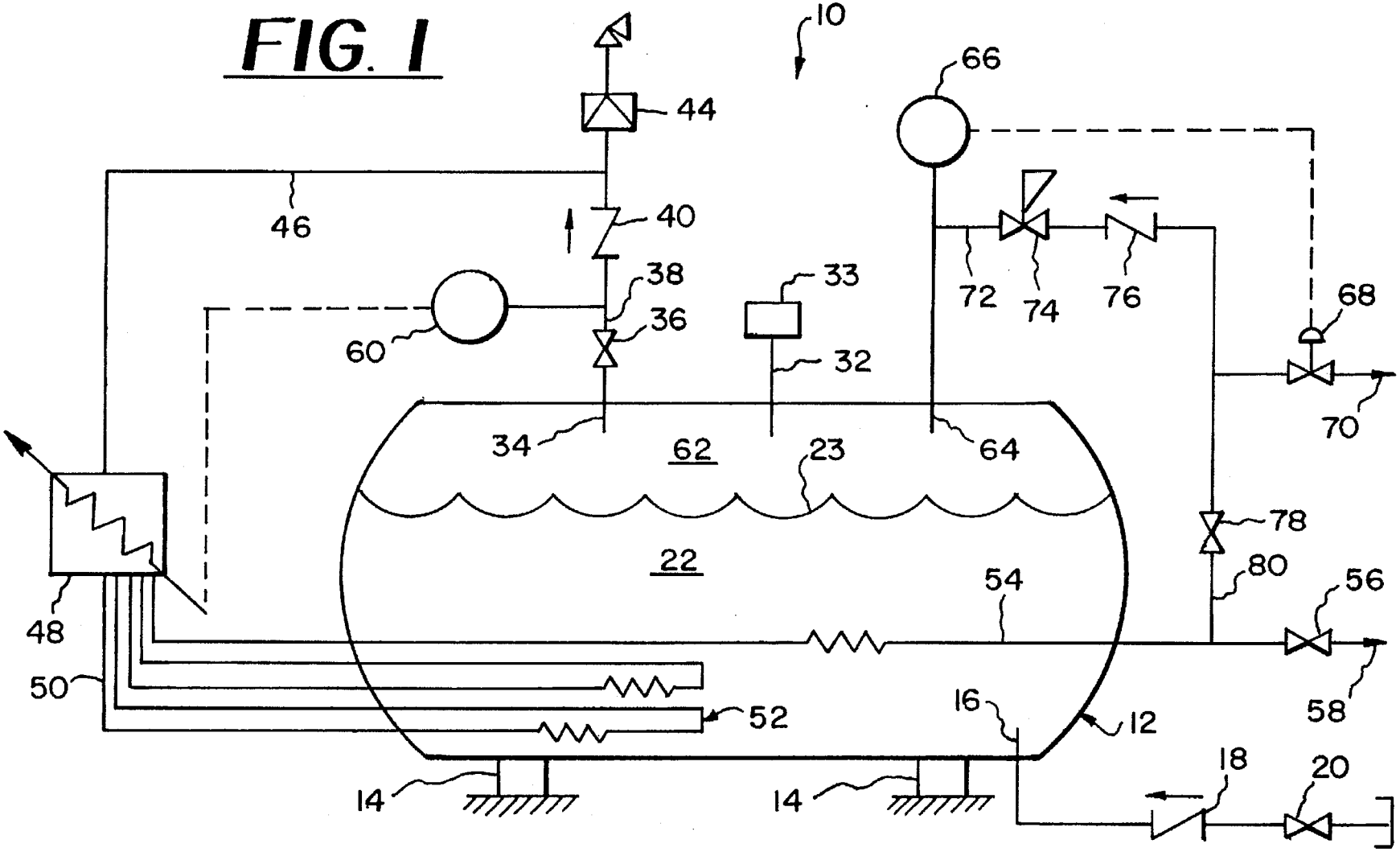
FIG. 1 is a schematic representation illustrating the method and apparatus of the present invention.

Referring to FIG. 1, the system shown generally as 10 includes a storage tank 12 supported on a rack, cradle, or supports 14 as is well known in the art. Tank 12 includes a fill conduit 16 with a check valve 18 and a control valve 20 to permit liquid product 22 to be introduced into the tank. Tank 12 also includes a vent conduit 32 which in turn is connected to a system 33 to vent over pressurization of the tank 12.

Tank 12 includes a vapor withdrawal conduit 34, a vapor withdrawal valve 36, and conduit 38 which in turn is connected to a check valve 40. Check valve 40 delivers the withdrawn vapor into a conduit 46, which in turn delivers the withdrawn vapor to a multiple pass heater 48. The multiple pass heater 48 provides heat in excess of that available from ambient conditions. This could be an electric heater, a fuel fired heater or any type of heater capable of providing heat in excess of ambient conditions, including heat imported from an adjacent industrial process. Safety relief valve 44 is connected to conduit 46 and prevents over pressurization of the withdrawal system. From multiple pass heater 48 vapor passes through conduit 50 into a multiple-pass heat exchanger 52 disposed in the liquid bath 22. Multiple pass heat exchanger 52 delivers the vapor to a conduit 54 which exits the tank 12 to deliver the process gas flow to a product delivery valve 56 and then to a point of use represented by arrow 58. Pressure indicating controller 60 is disposed in conduit 38 so that when a predetermined pressure is indicated in the vapor space 62 of tank 12, heater 48 will be turned off to prevent over-pressurization of tank 12. A second vent conduit 64 communicates with the vapor space 62 in tank 12. Conduit 64 is connected to a second pressure indicating controller 66 which has a preset value. Pressure indicating controller 66 is in turn connected to a control valve 68, which in turn is connected to a vent 70, which in turn is connected to the abatement system for the tank 12. The abatement system (not shown) can include a scrubbing system or any other system or receptacle for safe disposal of vented chemicals. Conduit 64 includes a branch conduit 72 with a pressure control valve 74, check valve 76, and control valve 78, between the vent conduit 64 and the delivery conduit 54. Control valve 74 in conjunction with check valve 76 will prevent undesired product venting through control valve 68. The vent conduit 64, pressure indicating controller 66, valve 68, valve 78, and conduit 80, coupled with heater 48, conduit 50, heat exchanger 52, and conduit 54 comprise a unique pressure maintenance system for the ultra high purity process gas in tank 12.

The method and apparatus of the invention illustrated in FIG. 1 can be applied to a storage vessel of any size. In operation, tank 12 will deliver ultra high purity gaseous product through the vapor delivery valve 36. The vapor or gaseous product is heated by means of electric heater 48 and forced through the tube bundle or multiple pass heat exchanger 52 contained inside of the tank 12 in the liquid product 22. Heating of the liquid product 22 by the vapor circulating through the multiple pass heat exchanger or tube bundle 52 will continue to generate ultra high purity vapor above the liquid surface 23 in the vapor space 62 of tank 12. This will maintain a constant tank pressure. As long as the pressure indicating controller 60 does not sense that the pressure inside the tank has exceeded the pre-set pressure limit, the heater will continue to heat the process gas as it is withdrawn from the tank through conduit 54.

According to the process of the present invention, in order to maintain a certain minimum delivery pressure, the equilibrium of vapor and liquid product inside the tank (storage container) 12 must remain above a corresponding minimum bulk temperature. During gaseous flow of product to the customer's house line through conduit 54, the loss of energy in the tank 12 is balanced by the amount of energy added using the external heater 48 and the amount of heat transfer into or out of the system, which is dependent upon the ambient temperature. When the ambient temperature is equal to the specified minimum bulk temperature of the fluid in the tank, no heat transfer will take place. Therefore, the heater 48 is the only source of energy to replace the energy loss due to product flow out of the tank. As the ambient temperature drops below the minimum specified bulk temperature of the product in the tank 12, the heater duty will increase. Depending on the heat capacity of liquefied gas, it will be necessary to use a multiple pass heat exchanger containing a number of passes designated "n" in order to compensate for the vapor loss. During unsteady conditions, such as fluctuating product usage by the customer, temperature of gas inside the tube bundle may rise rapidly due to a sudden no flow condition. Pressure rise in the tube bundle due to a rapid temperature rise will be dampened or relieved by pressure control valve 74, which will recycle the vapor into the tank 12 where any extreme condition of over pressurization can be handled by the normal tank vent system (not shown). In the event there is no demand for vapor product by the customer and a cold ambient temperature causes the tank pressure to fall below the minimum delivery pressure, pressure indicating controller 66 will automatically open vent valve 68 to allow a sufficient flow of vapor product through the heater 48 to heat the liquid product by passing gaseous product through heat exchanger 52 to heat and vaporize liquid product and raise the pressure of the gaseous product in the vapor space 62, thereby elevating the tank pressure above the minimum allowable level. In the event excess pressure is generated by overshooting the pressure set point for the tank 12, the gaseous product can be delivered through pressure control valve 74 to assist in maintaining tank 12 pressure. The overall process energy balance can be expressed by the equation:

$$Q_h+Q_c+Q_r=m\ h_v+dU_{cv} \quad (1)$$

where $Q_h$=Heat gain in tank provided by heater $Q_c$=Heat gain(+) or loss(−) in tank due to convection to atmosphere $Q_r$=Heat gain(+) or loss(−) in tank due to radiation to atmosphere m=Mass flow rate of gas product out of the tank $h_v$=Enthalpy of saturated vapor at tank pressure $dU_{cv}$=Change in internal energy of the tank The heat terms may be represented as follows:

$$Q_h=n\ m\ C_p dT_{htr} \quad (2)$$

$$Q_c=U_o A\ (T_o-T_{tank}) \quad (3)$$

$$Q_r=\sigma\epsilon A(T_o^4-T_{tank}^4) \quad (4)$$

where n=Number of heat exchange passes $C_p$=Specific heat of gas product at the tank pressure and temperature $dT_{htr}$=Temperature increase of the gas through the heater $U_o$=Overall convection heat transfer constant for the tank A=Surface area of the tank $T_o$=Ambient temperature in absolute scale $T_{tank}$=Bulk gas temperature in the tank in absolute scale σ=Stephan Boltzmann constant ϵ=Tank emmissivity constant Using the above equations in conjunction with system design data, one may determine the minimum number of heat transfer tube passes that is required to maintain a designated tank pressure according to:

$$n=\frac{mh_v+dU_{cv}+Q_c+Q_r}{mC_p dT_{htr}} \quad (5)$$

Based on this equation, there are three parameters that control what the value of n will be for a given fluid, namely, (a) the tank pressure, (b) the mass flow rate of the gas product, and (c) the heat transfer terms. The tank pressure is important as it directly affects the values for the enthalpy of the exiting vapor and the change in internal energy of the system. Assuming a constant tank pressure, the value of the vapor enthalpy remains constant, and the change in the tank's internal energy is directly proportional to the mass flow rate of the gas. The heat transfer terms from equation (5) may be collected and represented by a quantity α, where $$\alpha=\frac{Q_c+Q_r}{C_p dT_{htr}} \quad (6)$$

The quantity α represents the amount of heat lost by the tank (due to radiation and convection) relative to the heat gained by the tank. Since the value of α includes the specific heat of the process gas, the equation is universal in that it will apply for any liquefied compressed gas. Accordingly, one may plot lines for each n number of passes on a graph of mass flow rate versus quantity α at constant pressure, as shown in FIG. 2 for an ammonia system where the tank has an 8500 gallon capacity and an operating pressure of 80 psig.

Figure 2:
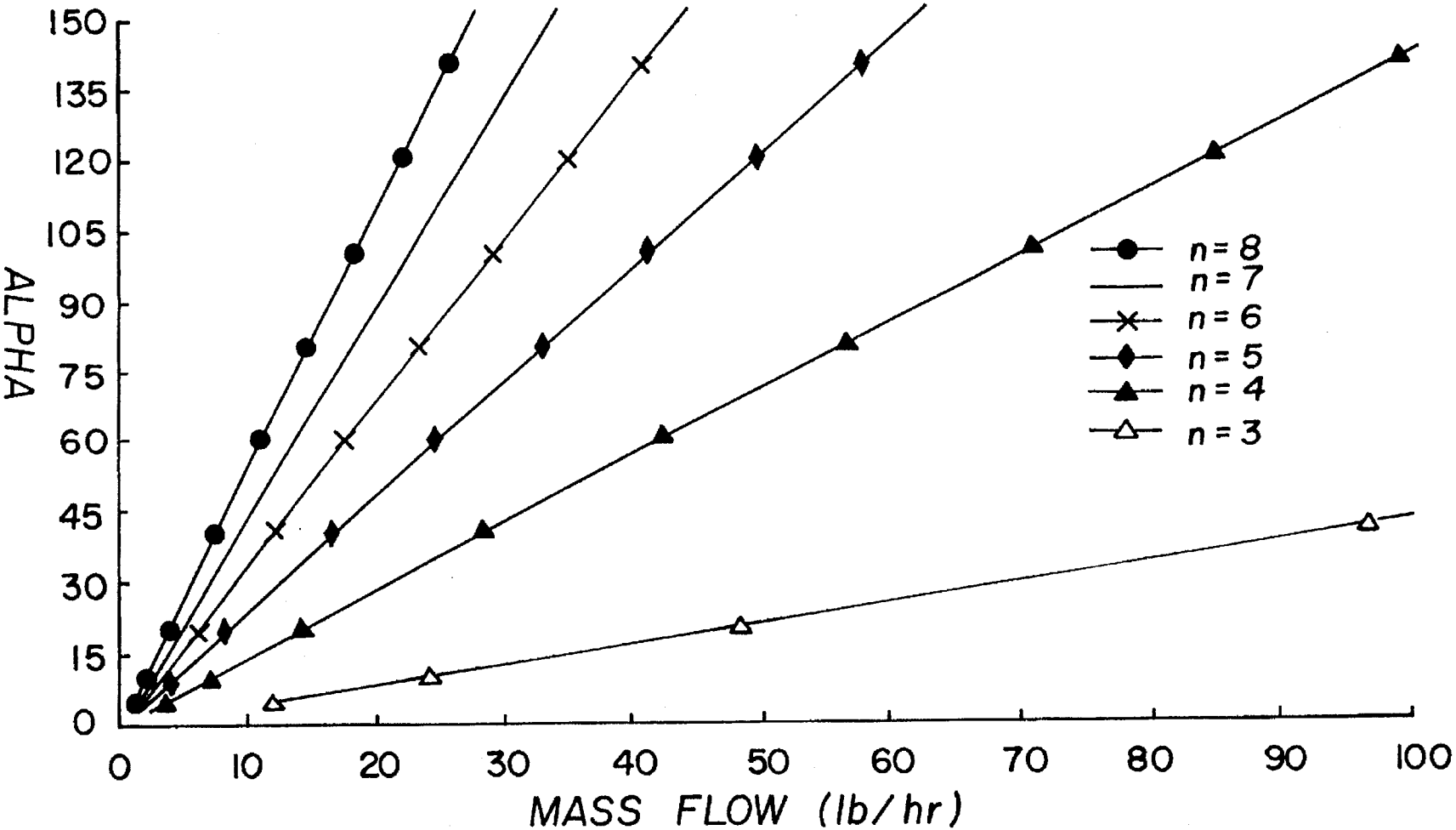
FIG. 2 is plot of mass flow against a quantity $\alpha$, for various numbers of passes through the heat exchanger where $\alpha$ represents the heat transfer characteristics of the storage vessel for an ammonia system.

The graph shown in FIG. 2 represents the operating characteristics of an $NH_3$ system where the number of heat exchange passes varies between three and eight. One can see that for a given mass flow rate, the system will need an increasing number of passes for increasing values of α. Or in other words, as the ratio of heat lost to heat gained by the tank increases, the imbalance may be offset by adding more heat exchange passes in the tank. Conversely, for a constant value of α, an increasing flow rate requires fewer heat exchange passes to maintain pressure. This is because a higher flow rate makes more heat available for heat exchange in the tank to replace the heat lost due to convection and radiation. Since more heat per pass is available, and the total heat required is fixed (because α is fixed), the number of required passes decreases. A system will operate satisfactorily provided it is running at any point below the line representing the number of active heat exchange passes in the system. If the system is running substantially below that line, one may save operating expenses by decreasing the value of $dT_{htr}$, which would serve to increase α and thus, run the system at a point closer to, but still below, the line representing the active number of heat exchange passes.

The method and apparatus according to the invention will be advantageous to users of high purity compressed liquefied gases for several reasons. First, by permitting delivery of ultra pure gas in bulk quantities, the invention eliminates the need for a large fab to maintain numerous cylinders and gas cabinets, which will minimize the number of components (e.g., valves, regulators, instruments, fittings, etc.), reduce equipment cost, reduce product cost, and reduce operating labor by eliminating numerous cylinder changes. The invention further eliminates equipment cost by eliminating the need for a purifier. Next, unlike a conventional pressure building circuit that vaporizes liquid and reinjects it into the vapor space of the vessel, the invention will maintain separation of vapor and liquid spaces at all times. This separation will enable the impurity concentration in the vapor space to be continually lower than that in the liquid space. Finally, since the process gas is used as the heat exchange media, any mechanical problems associated with the heat exchange tubes will not compromise the purity of the product, as would be the case if any other heat exchange fluid were selected.

The present invention is advantageous for fabs in another use. Traditionally, fabs have used large quantities of aqueous chemicals, such as ammonium hydroxide, as cleaning agents. Such chemicals are purchased in drums, and then pumped from a central storage and handling facility to the process application. As wafer diameters and production requirements continue to increase, fabs require larger volumes of the aqueous chemical products, which presents higher costs associated with transport and storage of the chemicals. The aforementioned invention will enable fabs to deliver sufficient quantities of ultra pure process gas at required pressures for on-site mixing with ultra pure water, to produce ultra pure aqueous chemicals such as ammonium hydroxide, in concentrations and volumes specific to the various semiconductor processing steps. In this regard, the production, storage, and delivery of the aqueous chemical is more controllable, and less susceptible to introducing impurities into the semiconductor manufacturing process.

Having thus described the invention, what is desired to be secured by Letters Patent of the United States is set forth in the appended claims.

What is claimed:

1. A method for delivering a gaseous product of ultra high purity from a storage tank containing an inventory of non-cryogenic liquid product with a gaseous vapor space above said liquid product, comprising the steps of:

withdrawing said gaseous product from said gaseous vapor space in said storage tank;

heating using a source of heat in excess of ambient heat and passing said withdrawn gaseous product in heat exchange relationship with said inventory of liquid product;

continuing to withdraw said gaseous product from said tank and heating and heat exchanging said withdrawn gaseous product with said liquid product as necessary to vaporize said liquid product in said storage tank to maintain pressure of said gaseous product inside said tank; and withdrawing and venting gaseous product during periods when no demand for said gaseous product is placed on said storage tank in order to maintain pressure of said gaseous product in said vapor space of said tank.

2. A method according to claim 1 wherein said liquid product is selected from the group consisting of $NH_3$, HF, $SiHCl_3$, $SiH_2Cl_2$, $C_4F_8$ and $C_3F_8$.

3. A method according to claim 1 including delivering said gaseous product to a point of use after heat exchange with said liquid product.

4. A method according to claim 1 including the step of continuously heating said withdrawn gaseous product prior to heat exchange with said liquid product when said ambient temperature is below a temperature where gaseous product delivery is adversely affected due to low pressure.

5. A method according to claim 1 including the step of maintaining gaseous product pressure in said tank at or above a certain delivery pressure.

6. A method according to claim 1 including the step of heat exchanging said withdrawn gaseous product with said liquid product by passing said gaseous product through multiple passes via a multiple pass heat exchanger connected to a multiple pass heater.

7. A method according to claim 6 including the step of relieving pressure in said multiple pass heater or said multiple pass heat exchanger to said tank when pressure rises due to a drop in demand by the user.

8. A method according to claim 6 including the step of determining the number of passes "n" through said multiple pass heat exchanger according to the following:

$$n = \frac{mh_v + dU_{cv} + Q_c + Q_r}{mC_p dT_{htr}}, \text{ where}$$

m=Mass flow rate of withdrawn gaseous product; $h_v$=Enthalpy of saturated vapor at tank pressure; $dU_{cv}$= Change in internal energy of tank; $Q_c$=heat gain or loss by tank due to convection; $Q_r$=Heat gain or loss by tank due to radiation; $C_p$=Specific heat of withdrawn gaseous product; $dT_{htr}$=Temperature increase of gas through said heater.

9. A system for delivering a gaseous product of ultra high purity comprising in combination:

storage tank adapted to contain liquid product and said gaseous product under pressure;

means to withdraw said gaseous product from said tank;

heater means to heat said gaseous product withdrawn from said tank with a source of heat in excess of ambient heat;

heat exchange means in said tank to exchange heat between said gaseous product withdrawn from said heater means and said liquid product contained in said tank;

means to deliver said gaseous product after heat exchange with said liquid product to a point of use;

pressure maintenance means to continuously withdraw gaseous product, heat said gaseous product and heat exchange said gaseous product with liquid product to maintain pressurized gaseous product in said tank regardless of demand for product delivery and/or use; and means to vent withdrawn fiaseous product to a process gas abatement system in the event there is no demand for delivery or use of said gaseous product.

10. A system according to claim 9 including means to relieve pressure in said heater means or said heat exchanger means to said tank when pressure rises due to a drop in demand by the user.

11. A system according to claim 9 wherein said tank is adapted to store said liquid product selected from the group consisting of $NH_3$, HF, $SiHCl_3$, $SiH_2Cl_2$, $C_4F_8$ and $C_3F_8$.

12. A system according to claim 9 including means to vent said storage tank under conditions of extreme over-pressure.

13. A system according to claim 9 including means to control heating of said gaseous product according to a pressure of said gaseous product in said tank.

14. A system according to claim 9 wherein said heater means is a multiple pass heater and said heat exchange means is a multiple pass heat exchanger.

* * * * *

UNITED STATES PATENT AND TRADEMARK OFFICE

CERTIFICATE OF CORRECTION

PATENT NO. : 5,644,921

DATED : July 8, 1997

INVENTOR(S) : Chowdhury, N. M.

It is certified that error appears in the above-indentified patent and that said Letters Patent is hereby corrected as shown below:

In the Claims:

Column 8, line 28, delete "fiaseous" and insert in its place -- gaseous --.

Signed and Sealed this

Sixteenth Day of September, 1997

*Attest:*

BRUCE LEHMAN

*Attesting Officer*

*Commissioner of Patents and Trademarks*